US006407494B1

(12) United States Patent
Maehara et al.

(10) Patent No.: US 6,407,494 B1
(45) Date of Patent: Jun. 18, 2002

(54) SHADOW MASK TYPE COLOR CATHODE RAY TUBE WHOSE PANEL SURFACE IS FLAT

(75) Inventors: Mutsumi Maehara, Mobara; Syunichi Matsumoto, Chiba, both of (JP)

(73) Assignees: Hitachi LTD, Tokyo; Hitachi Device Engineering Co., Hayano Mobara, both of (JP)

( * ) Notice: Subject to any disclaimer, the term of this patent is extended or adjusted under 35 U.S.C. 154(b) by 0 days.

(21) Appl. No.: 09/656,360

(22) Filed: Sep. 6, 2000

(51) Int. Cl.[7] ..... H01J 29/10
(52) U.S. Cl. ..... 313/461
(58) Field of Search ..... 313/461, 477 R, 313/402, 408

(56) References Cited

U.S. PATENT DOCUMENTS 6,066,914 A * 5/2000 Shimizu et al. ..... 313/477 R

* cited by examiner

*Primary Examiner*—Nimeshkumar D. Patel
*Assistant Examiner*—Thelma Sheree Clove
(74) *Attorney, Agent, or Firm*—Milbank, Tweed, Hadley & McCloy LLP

(57) ABSTRACT

A color cathode ray tube includes a panel having an outer surface which is flat and an inner surface which is a curved surface, and the inner surface has an approximately rectangular effective screen on which an image is to be displayed. Letting Tc, Td and D be, respectively, the glass thickness of the panel at the center thereof, the glass thickness of an end of a diagonal effective diameter, and half of the diagonal effective diameter, $(Td-Tc)/D \leqq 7.5\%$ and the maximum deflection angle is between 96° and 99°.

15 Claims, 6 Drawing Sheets

SHADOW MASK TYPE COLOR CATHODE RAY TUBE WHOSE PANEL SURFACE IS FLAT

BACKGROUND OF THE INVENTION

The viewability of the display screen of a color cathode ray tube can be improved by flattening the outer panel surface thereof. However, in a shadow mask type color cathode ray tube, it is necessary that the effective surface section of its shadow mask be given a curvature in order to maintain the mechanical strength of the shadow mask. To this end, even if the outer panel surface is made flat, it is necessary to give a curvature to the inner surface of a panel that opposes the shadow mask. This art is disclosed in Japanese Patent Laid-Open No. 64451/1998.

There are also demands for reductions in the entire lengths of color cathode ray tubes so that the spaces of display monitor sets can be made compact. A general method of reducing the entire length of such a color cathode ray tube is to increase the deflection angle of an electron beam. In a related-art cathode ray tube whose outer panel surface is round (a curved shape), deflection angles of 90°, 100° and 110° are employed. An increase in the deflection angle offers the merits of reducing the entire length of the cathode ray tube and reducing the distance between its main lens and its phosphor screen, thereby improving focus. However, in a cathode ray tube whose outer panel surface is flat, if the deflection angle is made large, there occurs the problem that raster distortion increases or a neck shadow easily occurs. Accordingly, there has not yet been any related art that can realize a cathode ray tube whose outer panel surface is flat and which has the required display performance.

SUMMARY OF THE INVENTION

The color cathode ray tube (color display tube) according to the present invention has a panel whose outer surface is nearly flat, and the entire length of the cathode ray tube can be reduced with the distortion of its screen raster being suppressed within a practical range, in spite of its sufficient neck shadow tolerance.

In the color cathode ray tube according to the present invention, letting D, Tc and Td be, respectively, half of a diagonal effective diameter, the glass thickness of the panel at the center thereof, and the glass thickness of a diagonal end of the effective screen, (Td−Tc)/D is set to 7.5% or less and the maximum deflection angle of an electron beam is set be between 96° and 99°.

BRIEF DESCRIPTION OF THE DRAWINGS

A preferred embodiment of the invention will be described in detail with reference to the following drawings, wherein.

DESCRIPTION OF THE PREFERRED EMBODIMENT

Figure 1:
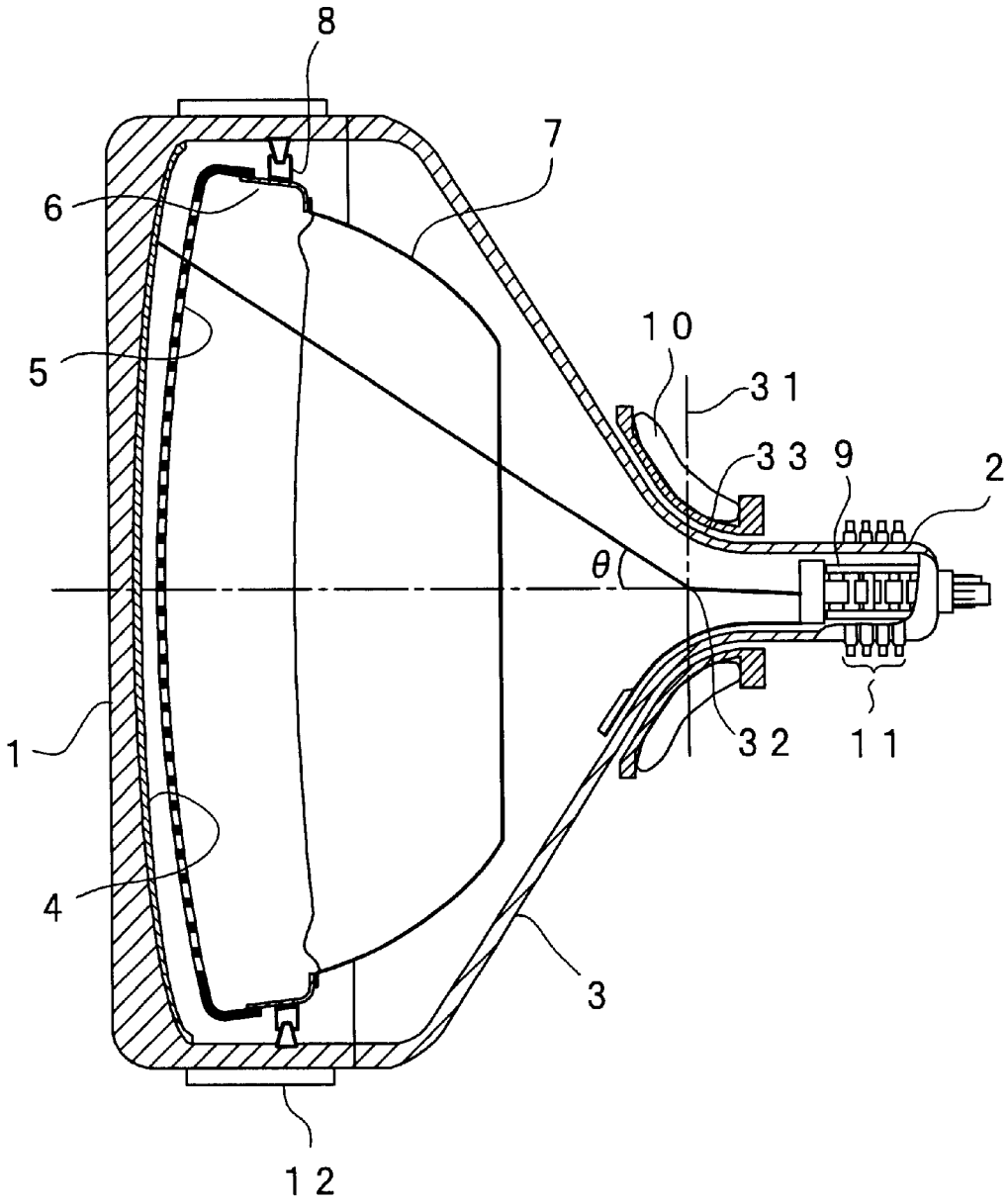
FIG. 1 is a schematic view of a color cathode ray tube according to the present invention.

FIG. 1 is a schematic view of a color display tube (CDT) whose panel portion has a diagonal size of 19 inches. A panel 1 has an outer surface which is flat, and an inner surface which is a curved surface. The diagonal outer size of this panel 1 is 492.8±1.6 mm. A neck 2 contains an electron gun 9 having an in-line arrangement, and is connected to the panel 1 by a funnel 3. An intersection point 32 of a reference line 31 and the tube axis is defined as a deflection center. The angle made with the tube axis by a line which connects the deflection center 32 and a point at which an electron impinges on the inner panel surface is defined as a deflection angle θ. This reference line 31 is a basis for the design of the color cathode ray tube, and is set to be displaced toward the panel 1 from the seal portion between the neck 2 and the funnel 3. The term "maximum deflection angle", as used herein, indicates an angle which is twice as large as the angle made with the tube axis by a line which connects the deflection center 32 and an end of a diagonal axis of the effective screen of the inner panel surface.

Dot type phosphors are formed on a phosphor screen 4. A shadow mask 5 has multiple round holes and is supported by a support frame 6, and is fitted to the panel 1 by a spring 8. The shadow mask 5 has an effective portion having multiple holes through which to pass electron beams. An inner magnetic shield 7 is set on the support frame 6. A deflection yoke 10 which deflects the electron beams is fitted to a conic portion 33 of the funnel 3. In the present embodiment, each of the deflection yoke 10 and the conic portion 33 of the funnel 3 to which the deflection yoke 10 is fitted has a rectangular cross-section in the direction perpendicular to the tube axis. A magnet assembly 11 adjusts the convergence and the purities of three in-line electron beams. A tension pad 12 prevents the implosion of the valve.

The reason why the outer panel surface is flat and the inner panel surface has a curvature is to give a curvature to the shadow mask 5. The glass thickness of the center of the panel 1 is 11.5 mm, and the periphery of the panel 1 is larger in glass thickness than the center because of the difference in curvature between the inner and outer panel surfaces. In the present embodiment, the shape of the outer panel surface, Zo(x, y), is given by the following defining equation:

$$Zo(x, y)=Rx-\sqrt{(Rx-Ry+\sqrt{Ry^2-y^2})^2-X^2},$$

where Rx=50,000 mm and Ry=80,000 mm.

The shape of the inner panel surface, Zi(x, y), is given by the following defining equation:

$$Zi(x, y)=Rx-\sqrt{(Rx-Ry+\sqrt{Ry^2-y^2})^2-X^2},$$

where Rx=1,650 mm and Ry=1,790 mm.

Effective diameters in the respective axial directions of the panel 1 of the color cathode ray tube of the present embodiment are as shown in Table 1.

TABLE 1

| Axis | Effective Diameter |
|---|---|
| Shorter-Axis Diameter | 274.3 mm |
| Longer-Axis Diameter | 365.8 mm |
| Diagonal-Axis Diameter | 457.2 mm |

Figure 2:
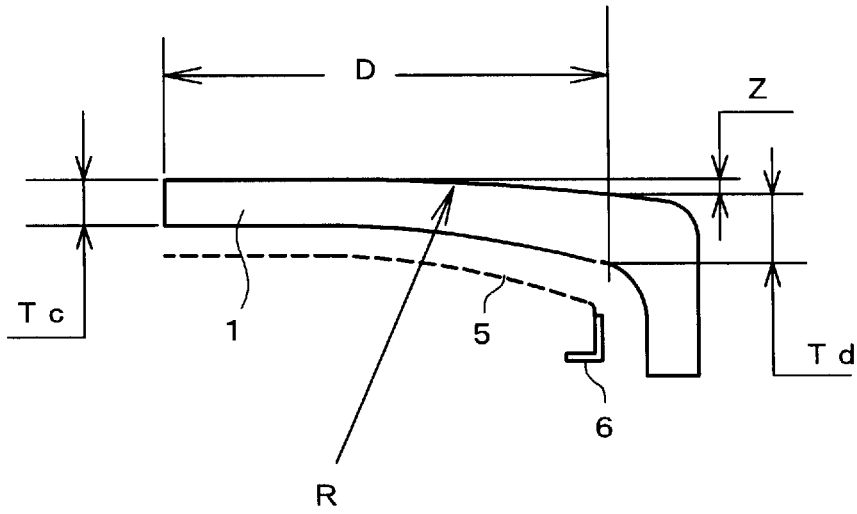
FIG. 2 is a cross-sectional view of a panel.
Figure 3:
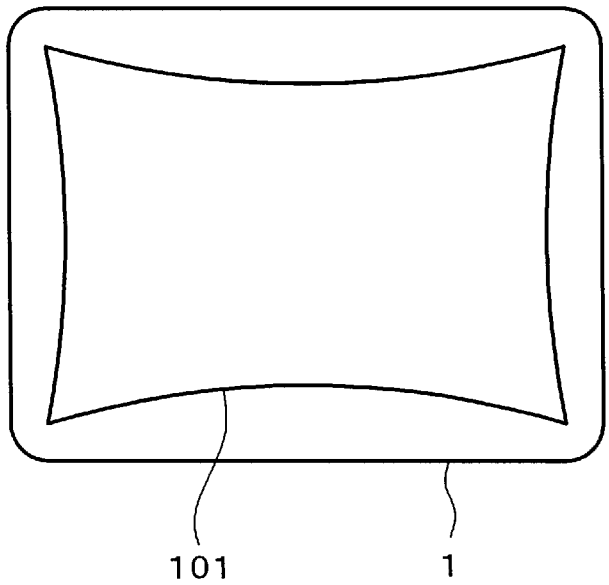
FIG. 3 shows an example of pincushion distortion of a raster.

A panel having a shape such as that of the present embodiment has different radii of curvature at different locations of the panel. Accordingly, as shown in FIG. 2, an equivalent radius of curvature R is defined as follows from the amount of depression of the periphery of the panel 1 with respect to the center of the panel 1:

$$R=(D^2+Z^2)/(2Z),$$

where D represents a value which is half of an effective diameter, and Z represents the difference in height between the center of the panel 1 and the edge portion of the effective surface of the panel 1. This equivalent radius of curvature can be defined for each of the shorter-axis, the longer-axis and the diagonal axis of the panel 1. If the equivalent radius of curvature in the direction of the diagonal axis of the outer panel surface is 10,000 mm or more, the outer panel surface looks nearly flat. In the present embodiment, the equivalent radius of curvature in the direction of the diagonal axis is 1,693 mm for the inner panel surface, and 52,258 mm for the outer panel surface.

Letting Tc and Td be, respectively, the glass thickness of the center of the panel 1 and the glass thickness of the periphery of the panel 1 at diagonal end of the effective screen, a wedge quantity W is defined as:

$$W=(Td-Tc)/D.$$

As the wedge quantity W becomes larger, the difference in radius of curvature between the outer panel surface and the inner panel surface becomes larger.

The shadow mask 5 has a curvature close to the radius of curvature of the inner panel surface. Accordingly, in the panel 1 whose outer surface is flat, if the inner panel surface is not given a curvature to give the panel 1 the wedge quantity W to some extent, the shadow mask is not given a sufficient curvature so that the mechanical strength of the shadow mask 5 becomes a problem. In a press forming type of shadow mask, the wedge quantity W of the panel 1 needs to be 5% or more, preferably, 5.5% or more. However, if the wedge quantity W is too large, a number of problems will occur; for example, the difference in glass thickness between the center and the periphery of the panel 1 becomes large, so that the difference in optical transmittance between the center and the periphery of the screen becomes large or the panel 1 becomes difficult to fabricate. Therefore, the wedge quantity W may be made 7.5% or less, preferably, 7.0% or less. The wedge quantity W of the panel 1 of the color cathode ray tube of the present embodiment is 6.6%.

However, if the inner panel surface is made approximately flat by decreasing the wedge quantity W in this manner, there occurs the problem that the raster shape 101 of the screen becomes a pincushion shape. This raster distortion becomes a serious problem in a high-resolution display tube having a horizontal resolution of 1,600 or more in particular.

Figure 4:
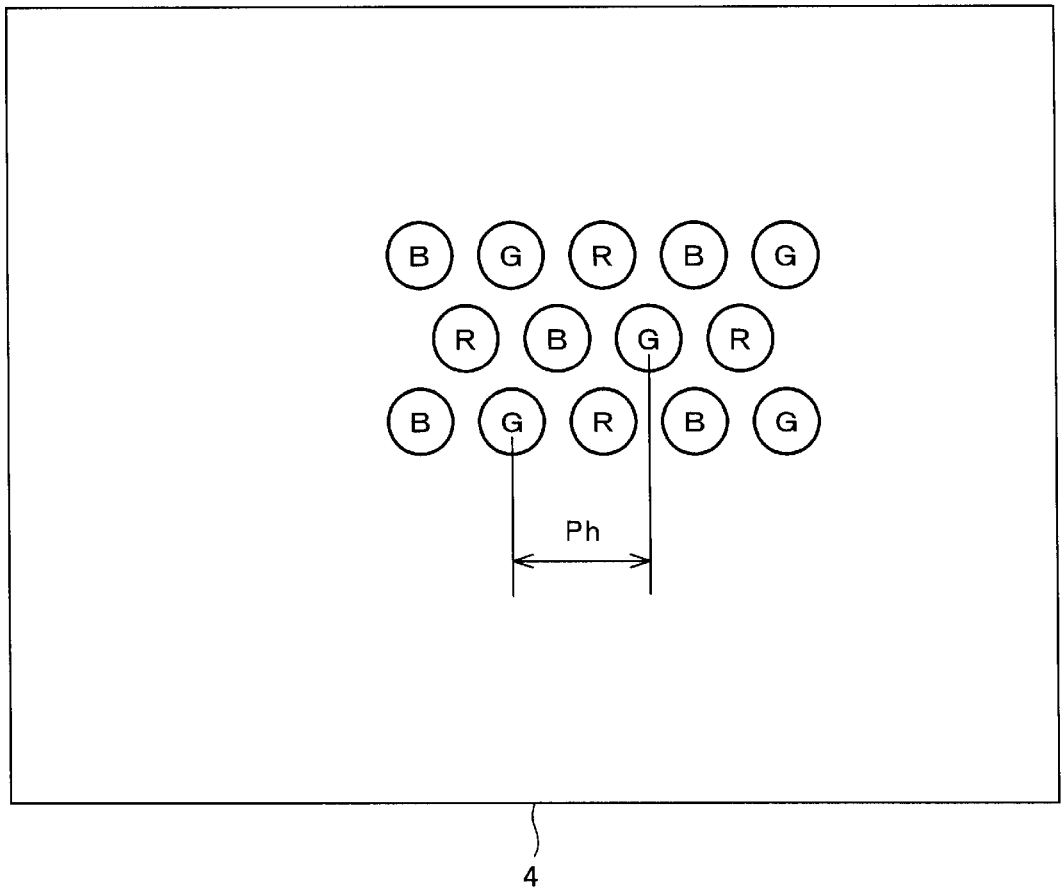
FIG. 4 shows an example of the arrangement of phosphor dots.

The horizontal resolution of 1,600 or more means that 1,600 or more phosphors consisting of phosphor pairs arrayed at a pitch Ph are present in horizontal direction as shown in FIG. 4. In FIG. 4, symbol G denotes a green phosphor, symbol B denotes a blue phosphor, and symbol R denotes a red phosphor. If an attempt is made to solve this raster distortion by using the characteristics of the deflection yoke 10, the value of BSN becomes small and the mass production of color cathode ray tubes becomes difficult. Actually, if color cathode ray tubes are to be mass-produced, the value of BSN needs to be 3 mm or more. The term BSN (Beam Strike Neck) means the distance by which the deflection yoke 10 is moved toward the electron gun 9 from a position where it is in intimate contact with the funnel 3 up to a position where a neck shadow occurs.

Figure 5:
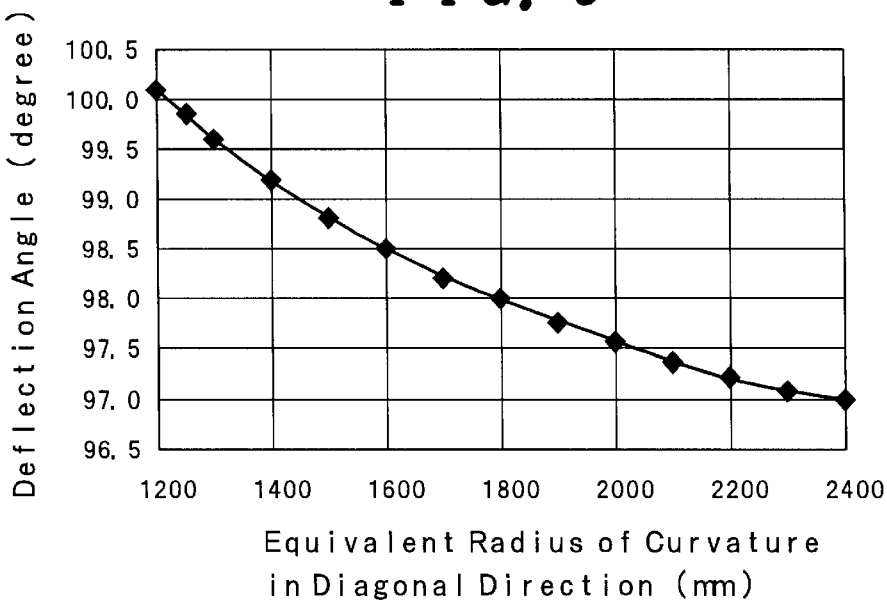
FIG. 5 shows the relationship between a deflection angle and the equivalent radius of curvature of an inner panel surface in the diagonal direction thereof.

This problem becomes more remarkable as the maximum deflection angle becomes larger. The present inventors have found out that if both raster distortion and BSN are to be taken into account, a certain relationship is needed between the curved surface of the inner panel surface and the electron-beam deflection angle. This relationship is shown in FIG. 5. If a practical value of BSN is ensured, the upper limit of the maximum deflection angle becomes smaller as the equivalent radius of curvature of the inner panel surface in the direction of the diagonal axis becomes larger. In FIG. 5, if the equivalent radius of curvature is 1,700 mm, BSN is 3.5 mm, and if the equivalent radius of curvature is 1,250 mm, BSN is 4.5 mm.

Figure 6:
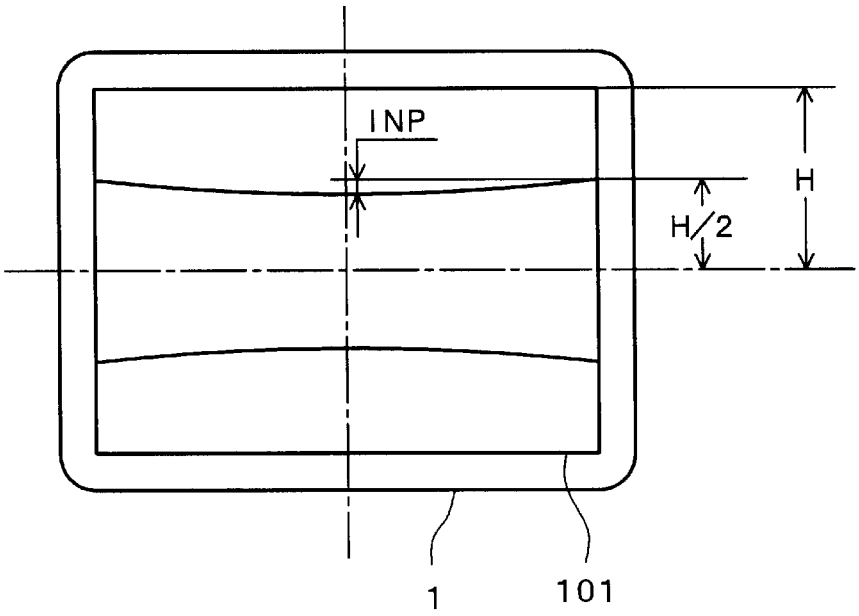
FIG. 6 shows an example of pincushion distortion of the present embodiment.

FIG. 6 shows the status of deflection distortion on the screen in the case of a deflection angle of 98.2° and a wedge quantity of 6.6%. At this time, BSN is 3.5 mm. FIG. 6 shows only the outermost upper and lower lines and intermediate lines in a case where a so-called crosshatched pattern is displayed on the screen. In the present embodiment, the outermost upper and lower lines are nearly straight lines, and the intermediate lines assume a slight pincushion shape. This is referred to as the inner pincushion distortion. In the present embodiment, the value of the inner pincushion distortion is 0.7 mm or less within an allowable range.

Figure 7:
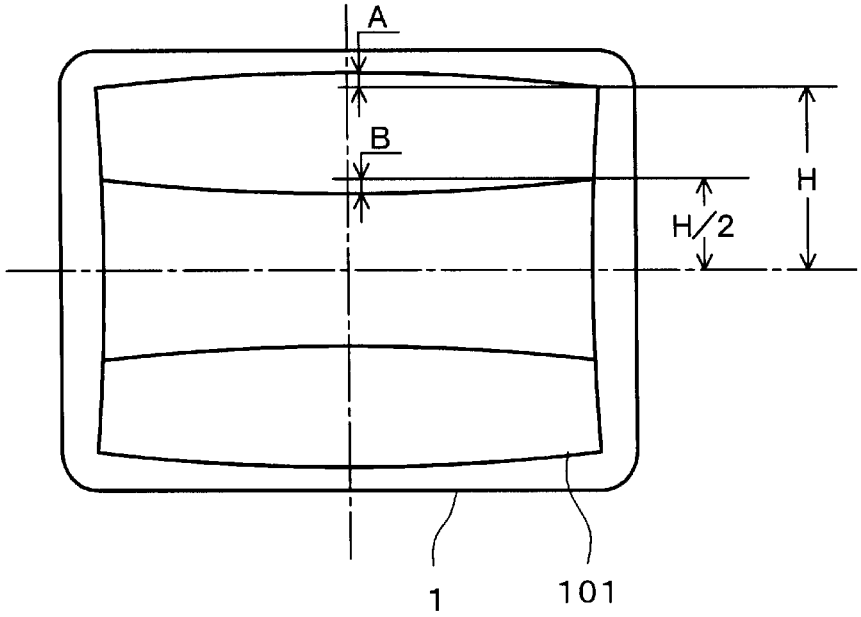
FIG. 7 shows a general example of pincushion distortion.

FIG. 7 shows a general crosshatched pattern. In FIG. 7, the outermost horizontal lines assume a slight barrel shape, but the intermediate lines assume a pincushion shape. Letting A and B be, respectively, the amount of deviation from the outmost straight line and the amount of intermediate pincushion distortion, an inner pincushion distortion INP is defined as INP=B−A/2. In the case where the outermost horizontal line assumes a pincushion shape, A has a plus value, while in the case where the outermost horizontal line assumes a barrel shape, A has a minus value. The reason why this evaluation is needed is that outer and inner distortions on the screen are similarly important. Even in a general case such as that shown in FIG. 7, the inner pincushion distortion INP needs to be INP≦0.7 mm.

In the case of a color cathode ray tube of the present embodiment having an external size of, for example, 19 inches, if the deflection angle is 96°, it is possible to reduce the entire length of the color cathode ray tube by 20 mm or more, compared to a color cathode ray tube having a deflection angle of 90°. On the other hand, if the deflection angle exceeds 99°, it becomes difficult to suppress raster distortion to within a practical range of CDT while ensuring the required BSN. Therefore, it is preferable to reduce the maximum deflection angle to 98.5° or less.

In the present embodiment, the deflection yoke is given a rectangular cross-section to prevent an increase in deflection power due to an increase in the deflection angle. As a matter of course, the conic shape of the funnel 3 of the present embodiment is also given a rectangular cross-section so as to be adapted to the deflection yoke. By using the rectangular deflection yoke, as compared with a round deflection yoke, the horizontal deflection sensitivity can be improved by 26% and the vertical deflection sensitivity can be improved by 12%. Thus, the pincushion distortion and BSN of the color cathode ray tube are ameliorated.

Since the present invention is applied to a color cathode ray tube which has a flat outer panel surface and a small wedge quantity, the equivalent radius of curvature of the shadow mask becomes large, and the mechanical strength and doming of the shadow mask becomes a problem. To solve the problem, U-INVAR (32%Ni-4%Co—Fe) is used as the material of the shadow mask. Improvements in strength and doming characteristics due to the use of this material are as shown in Table 2. In the following table, Young's modulus relates to the mechanical strength of the shadow mask, and a coefficient of thermal expansion relates to the characteristics of doming.

TABLE 2

| | U-INVAR | INVAR |
|---|---|---|
| Young's Modulus (Kgw/mm$^2$) | 14100 | 12200 |
| Coefficient of Thermal Expansion | $0.5 \times 10^{-6}$ | $1.5 \times 10^{-6}$ |

Figure 8:
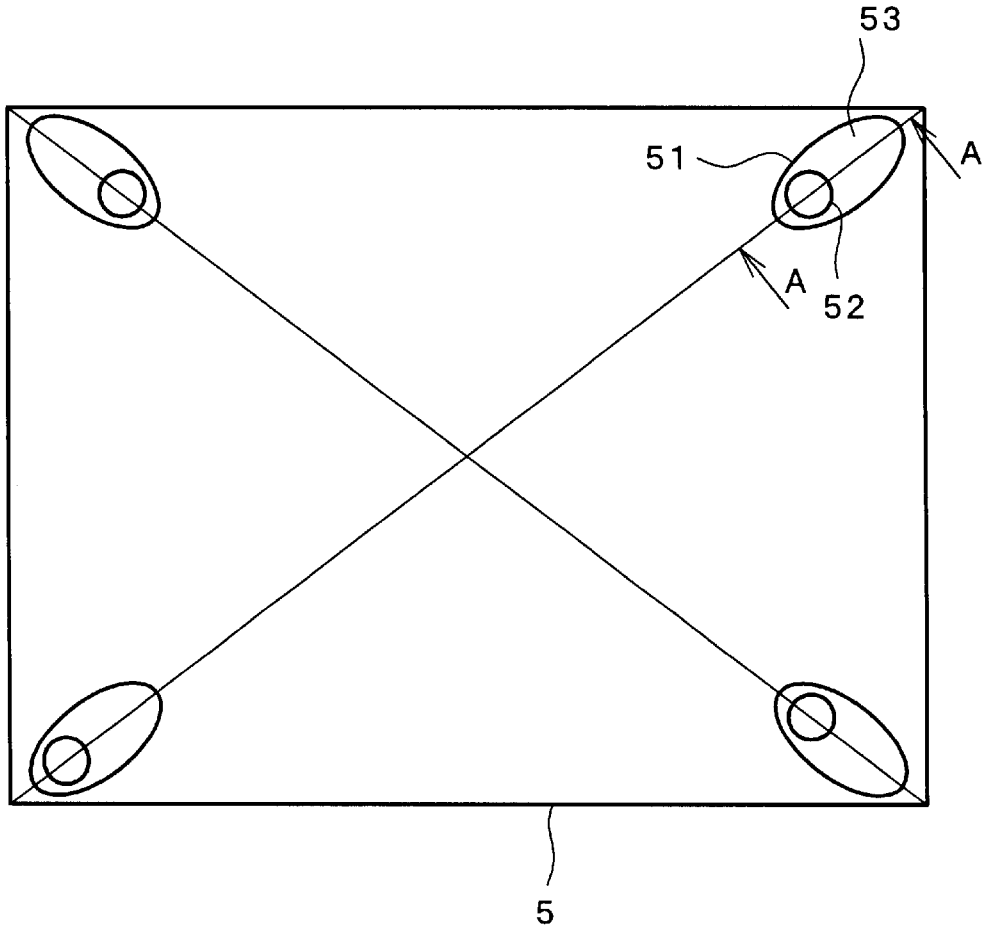
FIG. 8 is a plan view showing the shapes of shadow mask holes in the present embodiment.

In the present embodiment, holes in the peripheral portion of the shadow mask have a special shape so that the strength of the shadow mask is improved to a further extent. FIG. 8 shows the shapes of such holes in plan view. The reason why the large hole 51 shown in FIG. 8 is ellipsoidal is that the hole 51 is made large in size in the radial direction so that electron beams are prevented from impinging on a side wall 53 of the shadow mask, and the hole 51 is made small in both radial and perpendicular directions so that the average thickness of the shadow mask can be made large.

Figure 9:
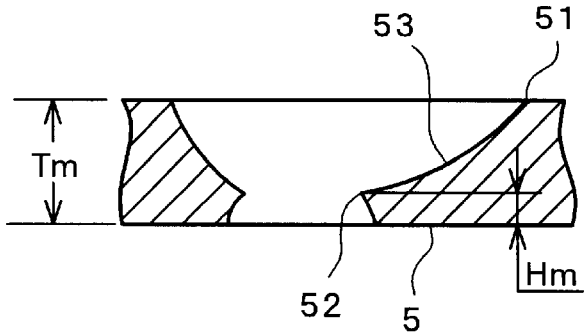
FIG. 9 is a schematic view showing in cross section the shape of a shadow mask in the present embodiment.

FIG. 9 is a cross-sectional view taken along line A—A of FIG. 8. In FIG. 9, symbol Hm denotes the value of a small hole 52 on the outer side thereof. Letting Tm be the thickness of the shadow mask, Hm/Tm is 0.20 or more, preferably, 0.25. In the present embodiment, the value of Hm/Tm is made large in order to ensure the strength of the shadow mask and prevent halation. The reason for this is that halation becomes a more serious problem as the deflection angle becomes larger.

Since the present invention is applied to a panel which has a flat outer panel surface and a curved inner panel surface, the central thickness and the peripheral thickness of the panel greatly differ from each other. For example, the central thickness of the panel is 11.5 mm, and the peripheral thickness of the panel is 26.5 mm. If the glass thickness of the panel differs in this manner, the ratio of central luminance to peripheral luminance becomes large in the case of a glass material of low optical transmissivity. In the present embodiment, a semi-clear glass of comparatively large optical transmissivity is used as its panel glass so that the difference in optical transmissivity between the center and periphery of the panel glass is made small.

Figure 10:
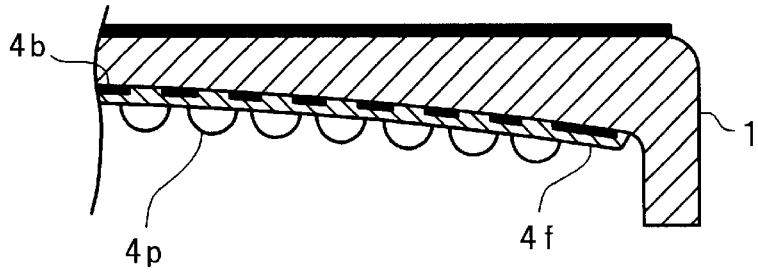
FIG. 10 is a cross-sectional view showing the construction of a panel in the present embodiment.

A decrease in contrast due to the increase of the optical transmissivity of the panel glass is compensated for by an inner surface filter 4*f* such as that shown in FIG. 10. The inner surface filter 4*f* is formed between a black matrix 4*b* and phosphors 4*p*, and a pigment contained in the inner surface filter 4*f* is mainly responsible for the characteristics of light absorption. A mixed pigment of blue and red pigments is used as the pigment so that the spectral absorption characteristics thereof are made as uniform as possible. The average particle size of the pigment contained in the inner surface filter 4*f* is 0.2 $\mu$m or less. The inner surface filter 4*f* has the effect of reducing external reflection from the inner panel surface, and also has the effect of making the curved surface of the inner panel surface inconspicuous. In the case of a panel on which only phosphors are formed with an inner surface filter omitted, the reflectance of external light is approximately 4.5%, but if an inner surface filter is also used in such a panel, the reflectance can be reduced to approximately 1–1.5%. The optical transmissivity of the inner surface filter formed in the present embodiment is nearly uniform at 79–85% over the entire phosphor screen.

Figure 11:
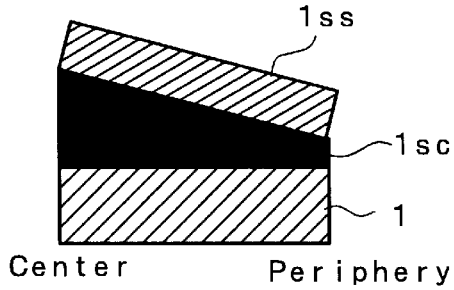
FIG. 11 is an explanatory view of the grading of a panel surface coat.

Even if a semi-clear panel glass of high optical transmissivity is used, it is impossible to completely solve the difference in luminance due to the difference in glass thickness between the center and periphery of the panel. To make far smaller the difference in luminance between the center and periphery of the panel, a panel surface coating 1*s* is made different in thickness between the center and periphery of the panel as shown in FIG. 11. The panel surface coating 1*s* includes a conductive layer 1*sc* formed on the glass panel 1 and a transparent $SiO_2$ layer 1*ss* formed on the conductive layer 1*sc*. The conductive layer 1*sc* is formed of metal ultrafine particles and has optical absorption characteristics. This conductive layer 1*sc* is formed to be thicker in the periphery of the panel 1 than in the center of the same, whereby the optical transmissivity in the center of the panel 1 is made lower than that in the periphery of the same. Thus, the difference in luminance between the center and periphery of the panel 1 is made small.

Figure 12:
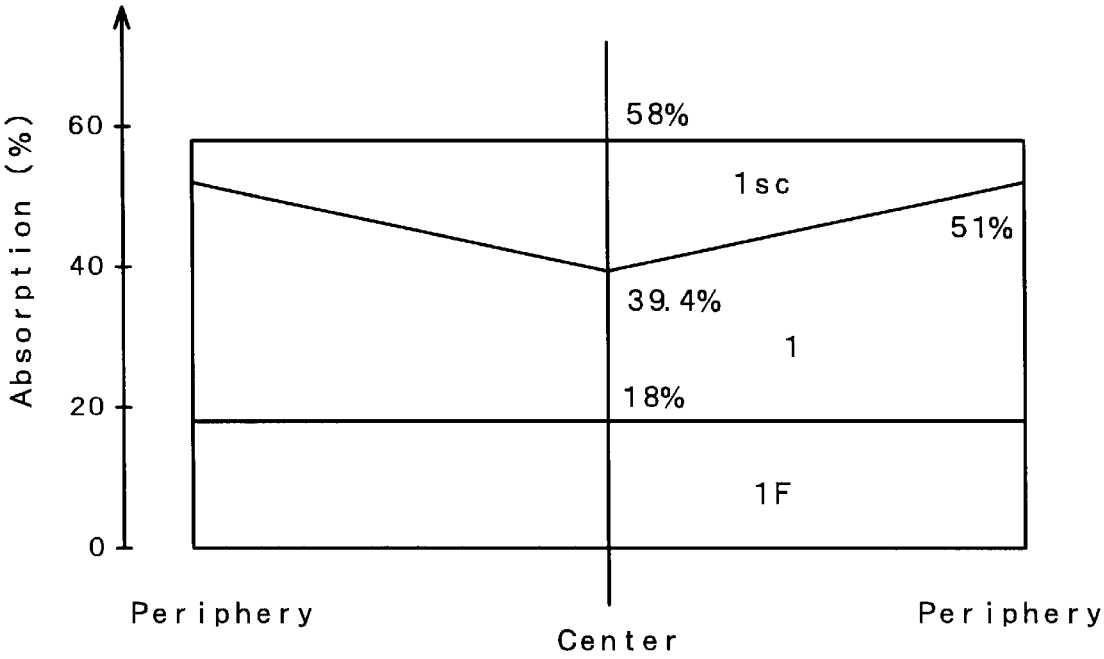
FIG. 12 is a graph illustrating the optical transmissivity of each constituent of the panel in the present embodiment.

FIG. 12 shows the proportion of optical transmissivity of each of the layers in the present embodiment. In FIG. 12, symbol 1F denotes the proportion of optical absorption of the internal surface filter, symbol 1 denotes the proportion of optical absorption of the panel glass, and symbol 1*ss* denotes the proportion of optical absorption of the panel surface coating. According to this construction, since raster distortion due to an increase in deflection angle is ameliorated, it is possible to provide a color cathode ray tube which is superior in contrast, luminance and uniformity, even if its wedge quantity is made large.

What is claimed is:

1. A color cathode ray tube comprising:

a panel having an outer surface which is flat and an inner surface which has a curved surface convex toward the outer surface, the inner surface having an approximately rectangular effective screen on which an image is to be displayed, letting Tc, Td and D be, respectively, the glass thickness of the panel at the center thereof, the glass thickness of a diagonal end of the effective screen, and half of the diagonal diameter of the effective screen, $$(Td-Tc)/D \leqq 7.5\%;$$

a neck portion which has an electron gun in its inside; and a funnel portion which connects the neck portion and the panel, the funnel portion having a conic portion on which a deflection yoke is to be set, in the vicinity of a portion connected to the neck portion, and also having a reference line displaced toward the phosphor screen from a seal portion between the neck and the funnel, assuming that an intersection point of the reference line and a tube axis is a deflection center and a maximum deflection angle is an angle which is twice as large as the angle made with the tube axis by a line which connects the deflection center and the diagonal end of the effective screen, the maximum deflection angle being between 96° and 99°.

2. A color cathode ray tube according to claim 1, wherein an equivalent radius of curvature of the outer panel surface in the direction of a diagonal axis is 10,000 mm or more.

3. A color cathode ray tube according to claim 1, wherein $5.0\% \leqq (Td-Tc)/D$.

4. A color cathode ray tube according to claim 1, wherein $5.5\% = (Td-Tc)/D \leqq 7.0\%$.

5. A color cathode ray tube according to claim 1, wherein the maximum deflection angle is 98.5° or less.

6. A color cathode ray tube according to claim 1, wherein a shadow mask is of a press forming type.

7. A color cathode ray tube according to claim 1, wherein the conic portion of the funnel portion is rectangular.

8. A color cathode ray tube according to claim 1, wherein the horizontal resolution of the screen is 1,600 or more.

9. A color cathode ray tube comprising:

a panel having an outer surface which has an equivalent radius of curvature of 10,000 mm or more in the direction of a diagonal axis, and an inner surface which has a curved surface convex toward the outer surface, the inner surface having an approximately rectangular effective screen on which an image is to be displayed, letting Tc, Td and D be, respectively, the glass thickness of the panel at the center thereof, the glass thickness of a diagonal end of the effective screen, and half of the diagonal diameter of the effective screen, $$(Td-Tc)/D \leqq 7.5\%;$$

a neck portion which has an electron gun in its inside; and a funnel portion which connects the neck portion and the panel, the funnel portion having a conic portion on which a deflection yoke is to be set, in the vicinity of a portion connected to the neck portion, and also having a reference line displaced toward the phosphor screen from a seal portion between the neck and the funnel, assuming that an intersection point of the reference line and a tube axis is a deflection center and a maximum deflection angle is an angle which is twice as large as the angle made with the tube axis by a line which connects the deflection center and the diagonal end of the effective screen, the maximum deflection angle being 96° or more, letting B be a deviation of an uppermost horizontal line of a cross-hatched pattern from a straight line with the cross-hatched pattern being displayed on the effective screen, and letting A be a deviation of a horizontal line from a straight line, which horizontal line is closest to a middle portion between a longer axis of a screen and the uppermost horizontal line, B−A/2 being 0.7 mm or less.

10. A color cathode ray tube according to claim 9, wherein $5.0\% \leqq (Td-Tc)/D$.

11. A color cathode ray tube according to claim 9, wherein $5.5\% \leqq (Td-Tc)/D = 7.0\%$.

12. A color cathode ray tube according to claim 9, wherein the maximum deflection angle is 98.5° or less.

13. A color cathode ray tube according to claim 9, wherein a shadow mask is of a press forming type.

14. A color cathode ray tube according to claim 9, wherein the conic portion of the funnel portion is rectangular.

15. A color cathode ray tube according to claim 9, wherein the horizontal resolution of the screen is 1,600 or more.

* * * * *